US005377585A

United States Patent [19]

Kipphan et al.

[11] Patent Number: 5,377,585

[45] Date of Patent: Jan. 3, 1995

[54] MULTIPLE DRIVE FOR A SHEET-FED ROTARY PRINTING PRESS

[75] Inventors: Helmut Kipphan, Schwetzingen; Uwe Tessmann, Nussloch, both of Germany

[73] Assignee: Heidelberger Druckmaschinen AG, Heidelberg, Germany

[21] Appl. No.: 41,839

[22] Filed: Apr. 1, 1993

[30] Foreign Application Priority Data

Apr. 2, 1992 [DE] Germany ..... 4210989

[51] Int. Cl.[6] ..... B41F 5/16

[52] U.S. Cl. ..... 101/181; 101/183; 101/177

[58] Field of Search ..... 101/181, 183, 184, 185, 101/180, 216, 136, 137, 138, 139, 142, 177, 229, 230, 231, 221, 224, 225, 228

[56] References Cited

U.S. PATENT DOCUMENTS

| | | | |
|---|---|---|---|
| 2,707,914 | 5/1955 | Harrold | 101/183 |
| 3,221,651 | 12/1965 | Tagliasacchi | 101/183 |
| 3,452,261 | 6/1969 | Tagliasacchi | 318/17 |
| 3,516,355 | 6/1970 | Giuiuzza | 101/183 |
| 3,557,692 | 1/1971 | Lee | 101/177 |
| 4,112,842 | 9/1978 | Jeschue | 101/183 |
| 4,183,296 | 1/1980 | Rambauseu | 101/181 |
| 4,214,526 | 7/1980 | Jeschue | 101/183 |
| 4,528,630 | 7/1985 | Sargent | 101/181 |
| 5,117,753 | 6/1992 | Mamberer | 101/225 |
| 5,127,324 | 7/1992 | Palmatier et al. | 101/181 |

FOREIGN PATENT DOCUMENTS

| | | |
|---|---|---|
| 2334177 | 1/1975 | Germany . |
| 2340263 | 2/1975 | Germany . |
| 2354541 | 5/1975 | Germany . |

*Primary Examiner*—Edgar S. Burr
*Assistant Examiner*—Lynn D. Hendrickson
*Attorney, Agent, or Firm*—Herbert L. Lerner; Laurence A. Greenberg

[57] ABSTRACT

Multiple drive for a sheet-fed rotary printing press having in-line printing units with drive gears driven via a closed gear train, the gear train connecting the printing units to one another and having two power-branching, interdependently controlled power-input locations includes two electric motors connected to said two power-input locations, respectively, at each one of two printing units, which have a third printing unit disposed therebetween, for driving the two printing units with directionally constant power flows of a divided and interdependently controlled driving power of the two electric motors meeting in the third printing unit disposed between the two driven printing units.

6 Claims, 5 Drawing Sheets

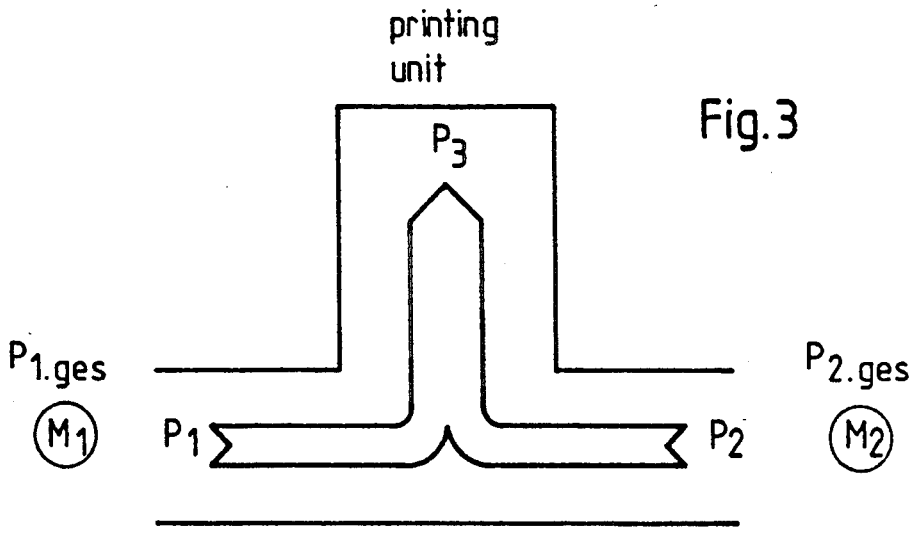
Fig. 3
Fig. 4
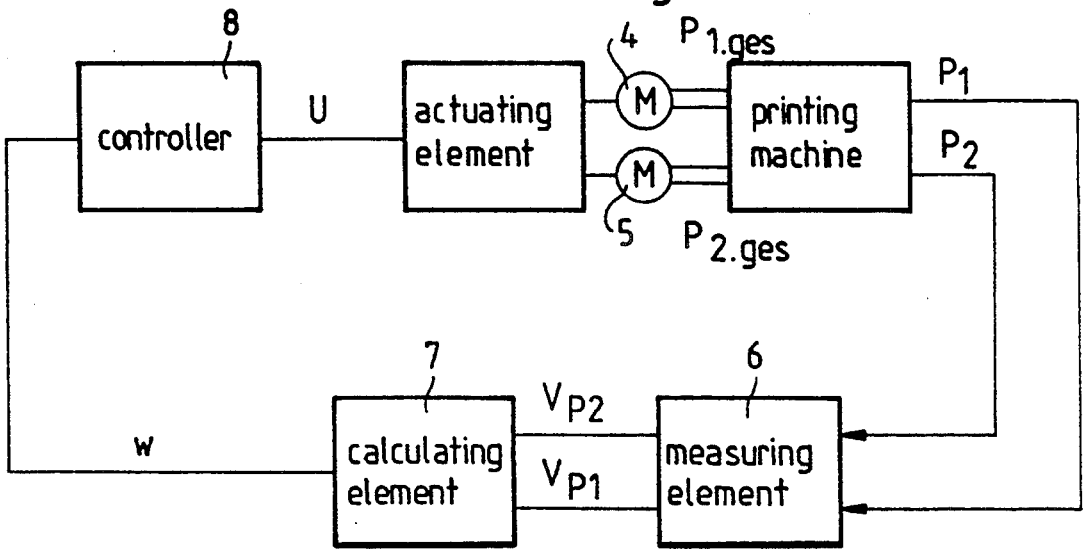

Fig.5
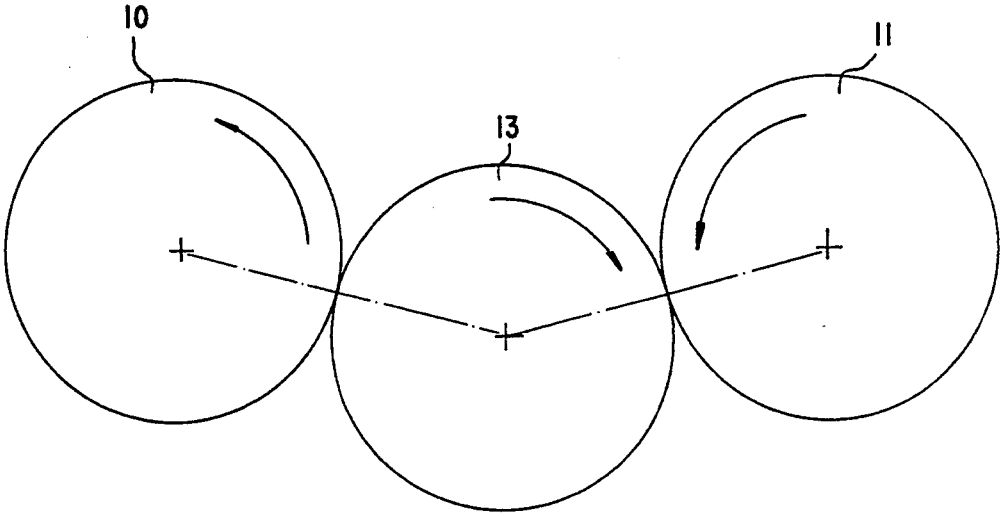
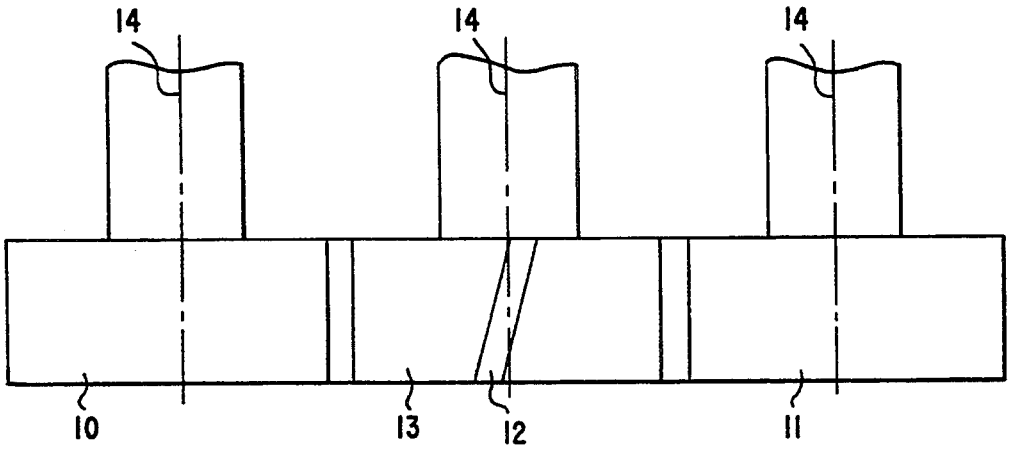
Fig.6

MULTIPLE DRIVE FOR A SHEET-FED ROTARY PRINTING PRESS

SPECIFICATION

The invention relates to a multiple drive for a sheet-fed rotary printing press and, more particularly, to such a press wherein drive gears of in-line printing units are driven by electric motors via a closed gear train having two power-branching, interdependently controlled power-input locations and connecting the printing units to one another and, possibly, to a feeder and a delivery.

Published German Patent Document 23 54 541 C3 describes such a multiple drive for a multi-color printing press composed of a number of in-line printing units. In order to attain a constant contact always between the tooth flanks or sides in the gear train, a defined power flow, deriving from one single drive motor, is achieved by providing that two gear-transmission or drive members, at two power-input locations, have a drive shaft passing therethrough which is axially displaceably mounted and is spring-loaded in the direction of displacement, the drive shaft having a driving torque transmitted thereto from the drive motor, but supplying only a portion of the power to each of the two power-input locations, with the result that a redundant or overdetermination of the drive is prevented.

According to published German Patent Document 23 40 263 C3, it is also possible for other gear-transmission or drive members between the two power-input locations or points to have displaceably disposed bearings and, for example, to be clamped hydraulically against one another.

An improvement in the effect of such measures for the purpose of achieving a defined, directionally constant power flow is sought after in an arrangement according to published German Patent Document 23 34 177 C3 by superimposing a slip clutch disposed in a secondary power circuit on the power-supplying means. Such heretofore known arrangements function only with single-motor drives and incur high loading values in parts of the printing-press drive.

Of practical use, are also so-called follower drives, in which the required driving power is supplied predominantly from one electric motor with, usually, a second electric motor or further following electric motors delivering a small contribution towards the required driving power. Although, even in the case of fluctuations in power consumption, this arrangement is able to provide a stable power flow from the main motor across the one or more secondary motors, the local power level remains relatively high in the region of the main motor.

In addition, hydraulic drives, hybrid drives and other solutions with one or more drive motors have become known heretofore for achieving a defined, directionally constant power flow also in the case of pronounced fluctuations in power consumption, however, the structural complexity thereof is considerably greater than for the aforementioned arrangements.

It is accordingly an object of the invention to provide an optimized multiple drive for a sheet-fed rotary printing press for multi-color printing having an appropriate number of printing units, which is made up of two electric motors having approximately equal power and being controllable by economical means to a defined power flow, even at high power fluctuations.

With the foregoing and other objects in view, there is provided, in accordance with the invention, a multiple drive for a sheet-fed rotary printing press having in-line printing units with drive gears driven via a closed gear train, the gear train connecting the printing units to one another and having two power-branching, interdependently controlled power-input locations, comprising two electric motors connected to the two power-input locations, respectively, at each one of two printing units, which have a third printing unit disposed therebetween, for driving the two printing units with directionally constant power flows of a divided and interdependently controlled driving power of the two electric motors Meeting in the third printing unit disposed between the two driven printing units.

In such an arrangement, two electric drive motors of approximately equal power supply a portion of their outgoing total power to the printing unit situated between the two motors, so that the printing unit acts as a power sink equally for both motors. The ratio of the amounts of power to be supplied to the printing-press drive by the two motors is determined within a control loop from the amounts of power supplied to the printing unit situated between the two motors. For this purpose, the torque transmitted from the two motors to the printing unit situated therebetween can be permanently measured and used as a controlled variable for controlling the power of the two drive motors. The controlled variable results from the quotient of the difference and the sum of the amounts of power supplied by the two motors to the printing unit situated therebetween and can be regarded as a relatively soft control criterion which prevents permanent adjusting maneuvers in the power control.

It is advantageous to reduce considerably the loading values in components of the printing-press drive as compared with conventional single-motor drives and so-called follower drives with one main motor and one or more secondary motors which are designed for a considerably smaller power output. The structural complexity required to implement this concept according to the invention is relatively small.

In accordance with another feature of the invention, the multiple drive includes control means for comparing respective portions of torque supplied by the two motors to the third printing unit, and for determining a ratio of the power supplied by the two motors, respectively, to each one of the two printing units connected to the respective motors.

In accordance with a further feature of the invention, each one of the two printing units has means for rotatably carrying a gear of the gear train for transmitting power from the two motors, respectively, to each of the two printing units connected thereto, a torque sensor connected to each of the gear-carrying means, and a control loop for the two motors including the torque sensor and supported by a computer wherein measured values from the torque sensors, with a dimensionless controlled variable included, control the power output of the two motors.

In accordance with a concomitant feature of the invention, and in order to determine the controlled variable in a conventional printing-press drive with a gearwheel drive or transmission between the two drive motors within a gear train extending over all of the printing units and, where appropriate, also a feeder and a delivery, the gearwheel drive comprises at least three spur gears, including two end spur gears and a middle spur gear therebetween, the three spur gears having intermeshing helical teeth and respective axes parallel to one another, a torque sensor comprising at least two distance sensors fixed to a stationary frame, the distance sensors, respectively, being directed at a plane surface on one of the two end spur gears, the two end spur gears, respectively, being connected to the two motors for transmitting power from each of the two motors, respectively, via the middle spur gear to the middle printing unit, and a measuring element, as well as an evaluation circuit integrated therein connected to the two end spur gears.

Such an arrangement makes it possible to determine the torque by measuring the deformations of a shaft or of a gearwheel. Due to the helical toothing of the spur gears, not only tangential peripheral forces occur at the circumference of the spur gears, but also forces in the axial direction of the measured gearwheel. The axial forces cause the shaft and the gearwheel to bend. By measuring the amount of bending, the evaluation apparatus electronically determines the instantaneously transmitted torque.

With regard to optimally obtaining measured values from gearwheel deformation and from shaft deformation, it is advantageous if a first pair of distance sensors is disposed on a straight line which is perpendicular to the parallel axes of the helically toothed spur gears and extends through the points of intersection of the axes of the measured gearwheel and of the respective, adjacent gearwheel with the plane. The second pair of distance sensors should then be disposed on a straight line likewise perpendicular to the parallel axes and extending through the point of intersection of the axis of the measured gearwheel with the plane and forming the axis of symmetry for the first pair of distance sensors. Such an arrangement is described in greater detail hereinafter in conjunction with an embodiment of the invention.

Other features which are considered as characteristic for the invention are set forth in the appended claims.

Although the invention is illustrated and described herein as embodied in a multiple drive for a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a diagram illustrating how power is supplied into a printing unit between two drive motors;

FIG. 4 is a block diagram showing how power to the printing press is controlled;

FIG. 5 is a diagrammatic and schematic front elevational representation of a gear transmission between the two drive motors and a printing unit intermediate thereto;

FIG. 6 is a top plan view of FIG. 5; and

Figure 1:
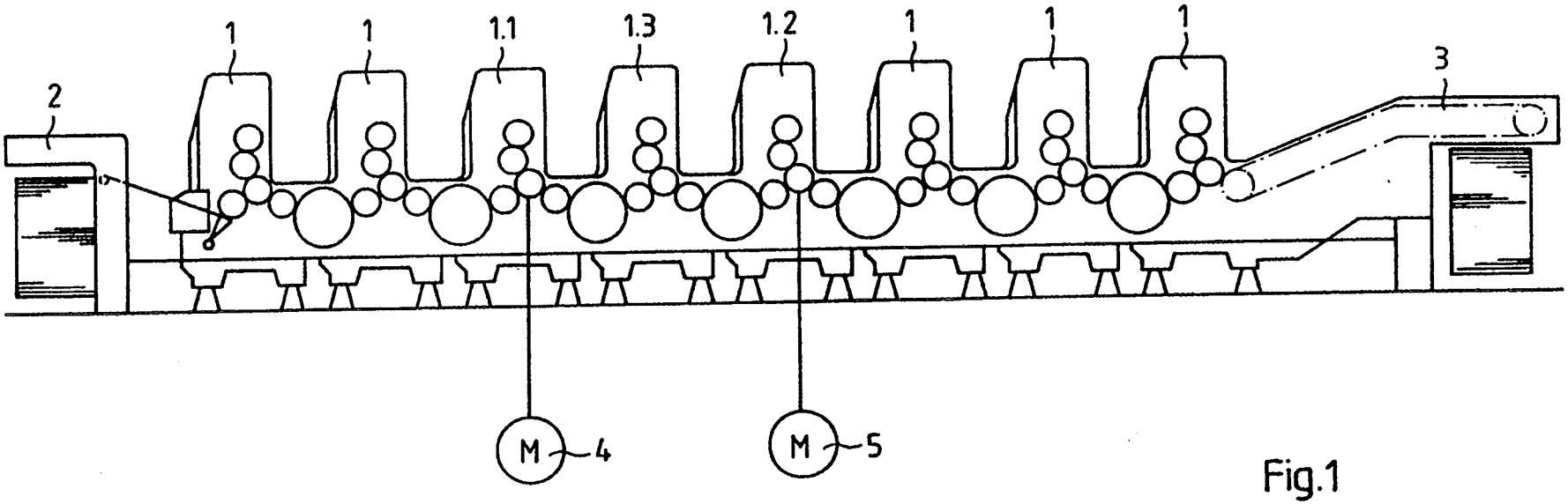
FIG. 1 is a diagrammatic and schematic side elevational view of a multi-color printing press.
Figure 2A:
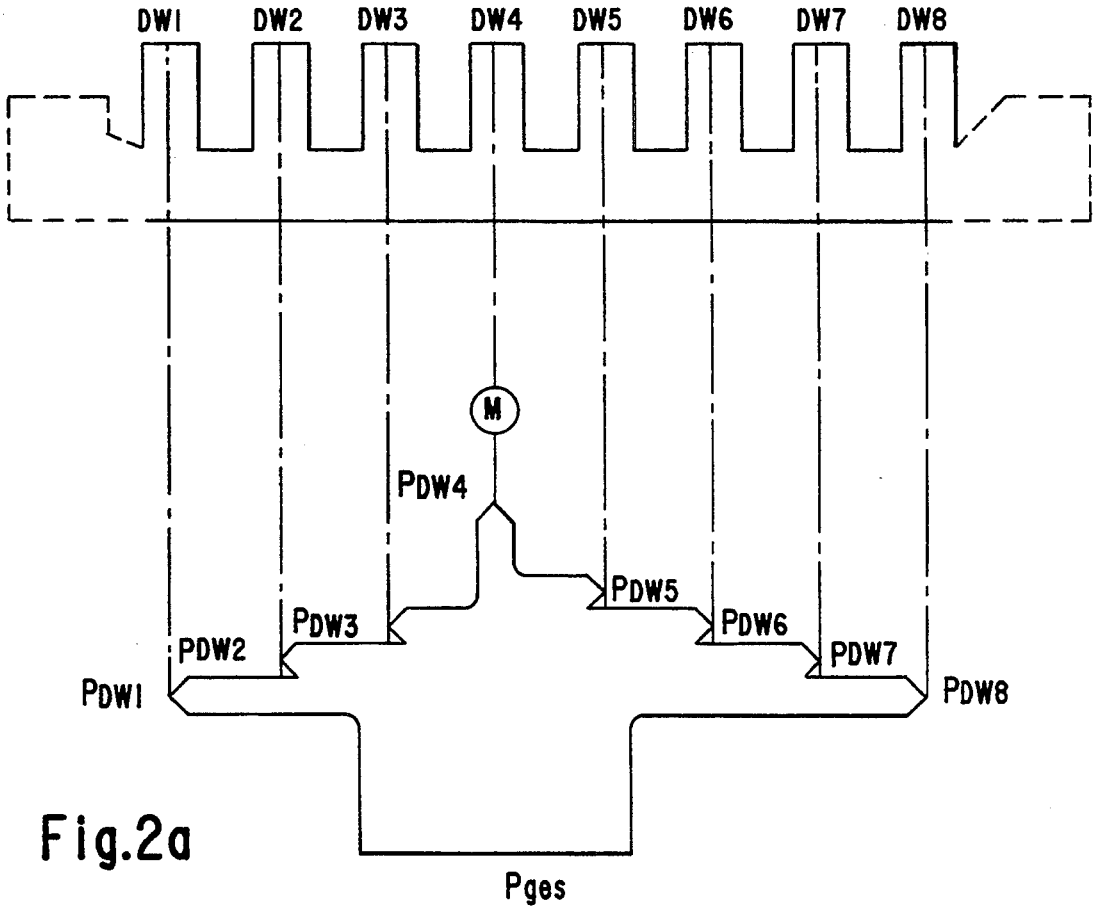
FIG. 2 is a Sankey diagram which explains the power branching in the printing press.
Figure 2B:
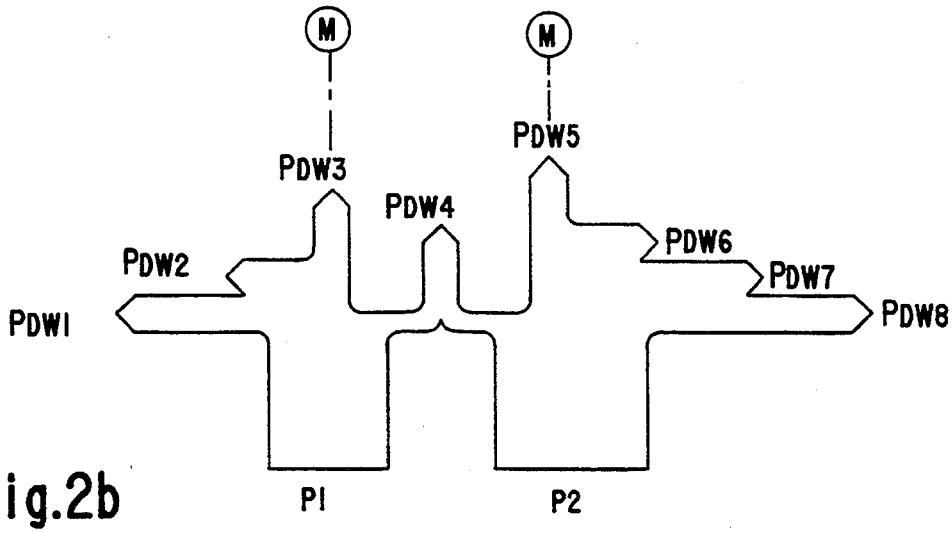

Referring now to the drawings and, first, particularly to FIG. 1 thereof, there is shown therein an in-line multi-color printing press for sheet-fed rotary printing, which is made up of several printing units 1, 1.2 and 1.3, a feeder 2 and a delivery 3. The printing units 1, 1.2 and 1.3 and, where appropriate, also the feeder 2 and the delivery 3 are driven via a closed gear train or transmission(not shown in the drawing) formed of intermeshing gearwheels. The drive therefor is effected, in accordance with the invention, by two power-controllable electric motors 4 and 5, respectively, driving one of two printing units 1.1 and 1.2, between which a further printing unit 1.3 is disposed. The sizes of both motors are designed for approximately like power. Both motors 4 and 5 supply power to a printing unit 1.3 situated between the motors. The ratio of the amounts of power to be supplied by the two motors 4 and 5 to the printing-press drive is determined within a control loop from the power components P1 and P2 (FIG. 3), which the motors supply to the printing unit 1.3 situated therebetween. The two power components P1 and P2 yield the driving power P3 of the intermediate printing unit 1.3 and are always greater than 0, with the result that a controlled variable W is yielded by the quotient of P1 minus P2 and the total power P1 plus P2 transmitted to the middle printing unit 1.3. The power components of both electric motors 4 and 5 are approximately of equal magnitude according to the representation in the Sankey diagram shown in the bottom part of FIG. 2. Power branching takes place to both sides, however, a portion of the power is also transmitted to the printing unit 1.3, which is situated between the printing units 1.1 and 1.2, both of which are driven by the electric motors 4 and 5, respectively. A comparison with the power branching of a single-motor drive, as shown diagrammatically at the top part of FIG. 2, reveals considerably reduced loading of the components of the drive.

In a practical application illustrated in FIG. 4, the power supplied by the two electric motors 4 and 5 to the printing unit 1.3 situated therebetween is measured by a measuring element 6 and is converted into electronic operands which are fed to a computing element 7. The computing element 7 produces the controlled variable W, which acts upon a controller 8, and the latter controls actuators 9 for the driving power from the electric motors 4 and 5.

Figure 7:
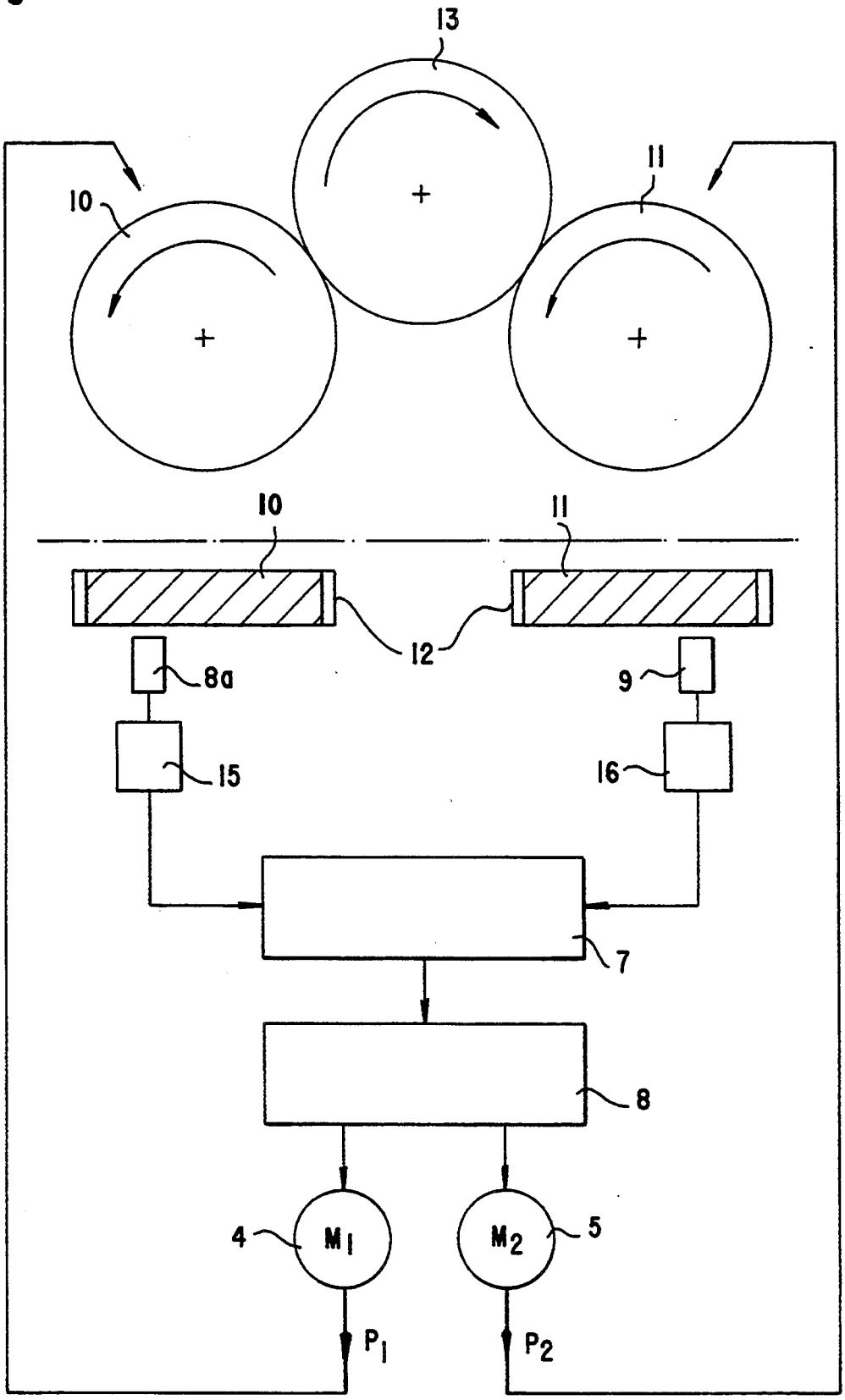
FIG. 7 is a diagrammatic and schematic view of a system for power control through the intermediary of torque measurement, in accordance with the invention.

In a preferred embodiment, as shown in FIG. 7, the power is measured by distance sensors 8*a* and 9, each one of which is directed, close to the root diameter, at a plane surface of the gearwheels 10 and 11, the gearwheel 10 being driven by the electric motor 4, and the other gearwheel 11 being driven by the electric motor 5. As shown in FIG. 6, both gearwheels 10 and 11 have helical teeth 12 which mesh with the teeth of the third gearwheel 13, the gearwheel 13 being associated with the drive of the intermediate printing unit 1.3. The printing unit 1.1 is driven via the gearwheel 10, and the printing unit 1.2 is driven via the gearwheel 11. Axes 14 of the shafts of the gearwheels 10, 11 and 13 extend parallel to one another. The magnitude of the axial forces occurring during power transmission due to the helical toothing is detected at the gearwheels 10 and 11 by the two distance sensors 8*a* and 9 and, in the selected embodiment of FIG. 7, is converted by oscillators 15 and 16 into electrical quantities which are fed to an evaluation circuit in the calculating element 7. The calculating element 7 produces corresponding controlled values W which, in the controller 8, produce controlled variables for the actuators which control the power of the driving motors 4 and 5. The distance sensors 8*a* and 9 are preferably contactless, high-accuracy and high-resolution sensors, particularly inductive sensors, eddy-current sensors or laser-triangulation sensors, particularly those that are marketed by specialist companies. Calibration is required in order to determine absolute values for the torque. Axial eccentricity of the plane surfaces on the gearwheels 10 and 11 can be eliminated in the evaluation circuit of the measuring element 6 by an in-phase combination of the measured values. As an alternative to the systematic functional description, distance sensors 8 and 9 may also be disposed in pairs on opposite sides of the gearwheels 10 and 11, in order to increase the sensitivity of the measuring arrangement by a sign-correct combination of the individual measured signals and by a suitable integration circuit of the two opposite sensors. The zero-value adjustment of the measuring arrangement may be effected for a nonloaded stationary gear transmission, with the measured gearwheels 10 and 11 in any angle-of-rotation positions, in order thus also to ensure long-term stability in the measurement of absolute values.

We claim:

1. Multiple drive for a sheet-fed rotary printing press having in-line printing units, drive means for driving the printing units, said drive means comprising drive gears driven via a closed gear train, the gear train connecting the printing units to one another and having two power-branching, interdependently controlled power-input locations, two electric motors connected to said two power-input locations, respectively, at each one of two printing units, which have a third printing unit disposed therebetween, said two electric motors operative for driving the two printing units with directionally constant power flows of a divided and interdependently controlled driving power of the two electric motors meeting in the third printing unit disposed between the two driven printing units.

2. Multiple drive according to claim 1, including control means for comparing respective portions of torque supplied by said two motors to the third printing unit, and for determining a ratio of the power supplied by said two motors, respectively, to each one of the two printing units connected to the respective motors.

3. Multiple drive according to claim 2, wherein each one of the two printing units has means for rotatably carrying a gear of the gear train for transmitting power from said two motors, respectively, to each of the two printing units connected thereto, a torque sensor connected to each of said gear-carrying means, and a control loop for said two motors including said torque sensor and supported by a computer wherein measured values from said torque sensors, with a dimensionless controlled variable included, control the power output of said two motors.

4. Multiple drive according to claim 1, including a gearwheel drive between said two motors, said gearwheel drive comprising at least three spur gears, including two end spur gears and a middle spur gear therebetween, said three spur gears having intermeshing helical teeth and respective axes parallel to one another, a torque sensor comprising at least two distance sensors coupled to said gearwheel drive fixed to a stationary frame, said distance sensors, respectively, being directed at a plane surface on one of said two end spur gears, said two end spur gears, respectively, being connected to said two motors, said two end spur gears operative for transmitting power from each of said two motors, respectively, via said middle spur gear to the third printing unit, a measuring element coupled to said distance sensors, and an evaluation circuit having inputs connected to said measuring element.

5. Multiple drive according to claim 1, wherein the gear train connects the printing units to a feeder.

6. Multiple drive according to claim 1, wherein the gear train connects the printing units to a delivery.

* * * * *